US007223106B2

(12) United States Patent
Nakajima et al.

(10) Patent No.: US 7,223,106 B2
(45) Date of Patent: May 29, 2007

(54) CONNECTOR AND ELECTRONIC APPARATUS HAVING THE SAME

(75) Inventors: Yuji Nakajima, Nishitama (JP); Kenji Kaji, Akishima (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/225,286

(22) Filed: Sep. 13, 2005

(65) Prior Publication Data

US 2006/0057869 A1 Mar. 16, 2006

(30) Foreign Application Priority Data

Sep. 14, 2004 (JP) ..... 2004-267243

(51) Int. Cl.
*H01R 12/00* (2006.01)

(52) U.S. Cl. ..... 439/74; 411/384; 411/388; 411/389; 411/178

(58) Field of Classification Search ..... 439/65, 439/74, 76.1, 83; 411/384, 388, 389, 178
See application file for complete search history.

(56) References Cited

U.S. PATENT DOCUMENTS 4,523,883 A * 6/1985 Peterson et al. ..... 411/171
4,577,402 A * 3/1986 Swanstrom ..... 29/840
4,587,377 A * 5/1986 Rodseth ..... 174/16.3
4,929,185 A * 5/1990 Wong et al. ..... 439/74
4,971,565 A * 11/1990 Fox, Jr. ..... 439/74
5,380,211 A * 1/1995 Kawaguchi et al. ..... 439/74
5,502,982 A * 4/1996 Venetucci ..... 62/374
5,575,686 A * 11/1996 Noschese ..... 439/620
6,019,613 A * 2/2000 Kataoka et al. ..... 439/83
6,249,442 B1 * 6/2001 Watanabe ..... 361/801
6,280,202 B1 * 8/2001 Alden et al. ..... 439/66
6,377,445 B1 * 4/2002 Davis et al. ..... 361/683
6,409,526 B1 * 6/2002 Malone et al. ..... 439/160
6,431,879 B2 * 8/2002 Brekosky et al. ..... 439/74
6,669,422 B1 * 12/2003 Sterle ..... 411/384
6,690,582 B2 * 2/2004 Sumida ..... 361/752
6,843,629 B2 * 1/2005 Farral et al. ..... 411/178
2003/0113183 A1 * 6/2003 McAfee ..... 411/107
2004/0258500 A1 * 12/2004 Ireland ..... 411/81

FOREIGN PATENT DOCUMENTS

JP 2002-319441 10/2002

* cited by examiner

*Primary Examiner*—Tho D. Ta
(74) *Attorney, Agent, or Firm*—Blakely Sokoloff Taylor & Zafman, LLP

(57) ABSTRACT

A connector includes: a first connector body having a plurality of first lead terminals soldered onto a first wiring board; a second connector body having a plurality of second lead terminals soldered onto a second wiring board; a screw member; and a fastening member engageable to the screw member. The first connector body and the second connector body are engaged with each other to bring the first lead terminals and the second lead terminals into contact such that the first lead terminals and the second terminals electrically connect the first wiring board to the second wiring board. The first and second wiring boards and the first and second connector bodies are integrally fastened together by engaging the screw member to the fastening member.

16 Claims, 12 Drawing Sheets

CONNECTOR AND ELECTRONIC APPARATUS HAVING THE SAME

This application is based upon and claims the benefit of priority from prior Japanese Patent Application No. 2004-267243, filed Sep. 14, 2004, the entire contents of which are incorporated herein by reference.

BACKGROUND OF THE INVENTION

1. Field of the Invention

The present invention relates to a connector which is interposed between two opposing wiring boards and which electrically connects the wiring boards to each other, as well as to a method for holding the connector unit between wiring boards. Furthermore, the invention relates to an electronic apparatus, such as a portable computer, having the connector.

2. Background Art

In an electronic apparatus, such as a portable computer or a cellular phone, two printed wiring boards disposed so as to face each other are electrically connected together by way of a connector known as a stacking connector.

The connector has a first connector body mounted on one printed wiring board and a second connector body mounted on the other printed wiring board. The first and second connector bodies are removably fitted together, and interposed between the two printed wiring boards, as well.

The first and second connector bodies respectively support a plurality of lead terminals. Each of the lead terminals has a first section soldered onto a pad on the printed wiring board, and a second section exposed to a fit portion between the first and second connector bodies. When the first connector body and the second connector body are fitted together, the second sections of the lead terminals of the first and second connector bodies are brought into contact. By means of this contact, the two printed wiring boards are electrically connected.

Meanwhile, in a conventional connector, mounting strength of the first connector body with respect to the printing wiring board and that of the second connector body are likely to depend on strength of the respective soldered portions of the lead terminals. Therefore, when an absolute amount of solder is reduced with an increase in density of pads or with miniaturization of lead terminals, cracks often arise in a soldered portion of the lead terminal as a result of a large external force being exerted on the soldered portion between the lead terminal and the corresponding pad. This crack becomes greatly responsible for faulty continuity of the connector unit.

A conventionally-practiced countermeasure against the above is to individually fix the first and second connector bodies to the printed wiring boards by means of screws. Hence, since the external force exerted on the soldered portion between the lead terminal and the pad is received by the screw, damage, which may otherwise be inflicted on the soldered portion, can be prevented.

In another known example of a connector unit, a positioning pin is fixed on a first connector body, and a through hole, which allows insertion of the pin, is formed in a second connector body and in a printed wiring board—on which the second connector body is to be mounted. In the connector, the positioning pin continually passes through the two printed wiring boards, and the first and second connector bodies. Therefore, external force exerted on a soldered portion between a lead terminal and a pad and on a contact portion between the lead terminals can be received by the pin (see, e.g., JP-A-2002-319441).

SUMMARY OF THE INVENTION

When the first and second connector bodies are individually fixed to the printed wiring boards by means of screws, mounting strength of the first and second connector bodies with respect to the printed wiring boards is increased. However, the positions of the first and second connector bodies remain constrained by means of merely fitting.

Therefore, when, for instance, a strong impact, or stress resulting from a difference in thermal expansion is exerted on a fit portion between the first connector body and the second connector body, inevitably unbearable force is applied on a contact portion between the lead terminals. As a result, the contact state between the lead terminals is changed, whereby plating layers covering the surface of the lead terminals are sometimes exfoliated.

In particular, when a contact pressure between the lead terminals is low, an impact applied on the first and second connector bodies causes the lead terminals to vibrate, and sometimes to rub against each other. As a result, the plating layers on the surfaces of the lead terminals are shaved off, and metal powder produced by the shaving stays between the lead terminals as sludge. Consequently, contact resistance between the lead terminals is increased, thereby inducing a problem of heating of the connector or occurrence of faulty continuity.

Meanwhile, according to JP-A-2002-319441, a clearance is present between an outer face of a pin and an inner face of an insertion hole for allowing insertion of the pin. Accordingly, although the pin passes through the printed wiring boards, and the first and second connector bodies, the printed wiring boards, the first connector body, and the second connector body cannot be constrained firmly so as not to move each other.

Therefore, the configuration disclosed in JP-A-2002-319441 includes a problem that, when, for instance, large force is exerted on the connector, the soldered portion between the lead terminal and the pad is cracked and that a contact state between the lead terminals becomes unreliable.

The present invention aims at providing a connector which can ensure sufficient mounting strength of the first and second connector bodies with respect to the first and second printed wiring boards, and can reduce stress applied on the contact portion between the lead terminals, to thus enhance reliability of electric connection; as well as a method for holding the connector.

Another object of the invention is to provide an electronic apparatus having the connector.

The invention provides a connector including: a first connector body having a plurality of first lead terminals soldered onto a first wiring board; a second connector body having a plurality of second lead terminals soldered onto a second wiring board; a screw member; and a fastening member engageable to the screw member; wherein the first connector body and the second connector body are engaged with each other to bring the first lead terminals and the second lead terminals into contact such that the first lead terminals and the second terminals electrically connect the first wiring board to the second wiring board; and the first and second wiring boards and the first and second connector bodies are integrally fastened together by engaging the screw member to the fastening member.

The invention may a connector including: a first connector body having a plurality of first lead terminals soldered onto a first wiring board; a second connector body having a plurality of second lead terminals soldered onto a second wiring board; a first screw member; and a second screw member; wherein the first connector body and the second connector body are engaged with each other to bring the first lead terminals and the second lead terminals into contact such that the first lead terminals and the second terminals electrically connect the first wiring board to the second wiring board; and the first and second wiring boards and the first and second connector bodies are integrally fastened together by the first screw member and the second screw member.

The invention provides an electronic apparatus including: an enclosure; a first wiring board contained in the enclosure; a second wiring board contained in the enclosure so as to oppose the first wiring board; and a connector unit interposed between the first wiring board and the second wiring board; wherein the connector unit includes: a first connector body having a plurality of first lead terminals soldered onto a first wiring board, a second connector body having a plurality of second lead terminals soldered onto a second wiring board, a screw member, and a fastening member engageable to the screw member; the first connector body and the second connector body are engaged with each other to bring the first lead terminals and the second lead terminals into contact such that the first lead terminals and the second terminals electrically connect the first wiring board to the second wiring board; and the first and second wiring boards and the first and second connector bodies are integrally fastened together by engaging the screw member to the fastening member.

According to the invention, a load for preventing relative movement between the first printed wiring board, the second printed wiring board, the first connector body, and the second connector body can be applied, thereby providing firm restraint. Therefore, damage which may be otherwise be inflicted on the soldered portions between the first and second printed wiring boards and the lead terminals can be prevented, and stress applied on a contact portion between lead terminals can be reduced, thereby enhancing reliability of electric connection.

BRIEF DESCRIPTION OF THE DRAWINGS

The present invention may be more readily described with reference to the accompanying drawings.

DETAILED DESCRIPTION OF THE EMBODIMENTS

Hereinbelow, a first embodiment of the invention will be described by reference to FIGS. 1 to 5.

Figure 1:
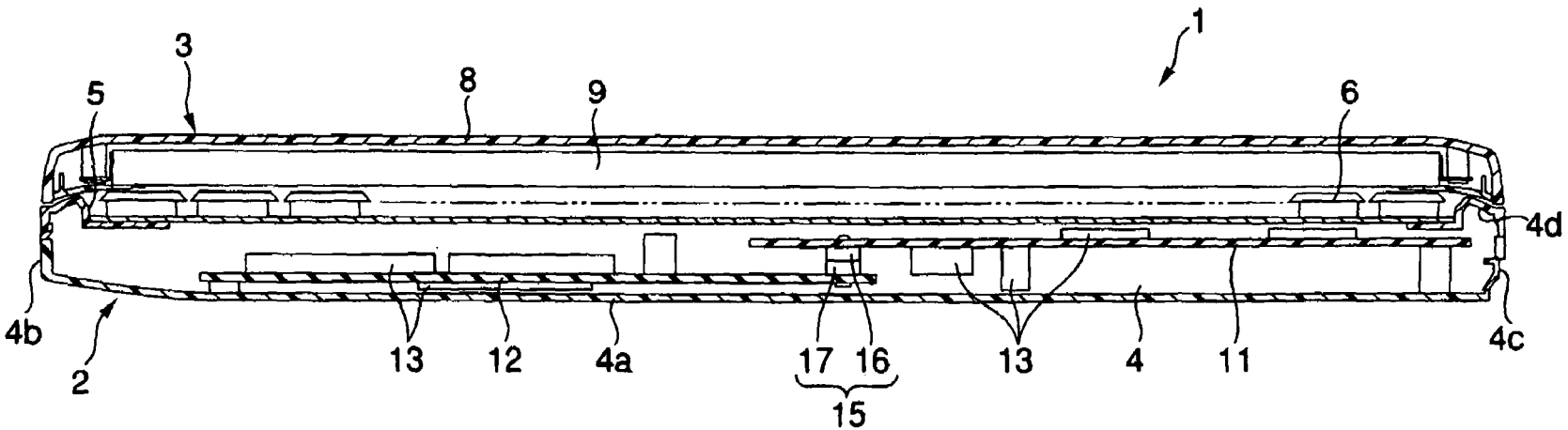
FIG. 1 is a cross-sectional view of a portable computer according to a first embodiment of the present invention.

FIG. 1 shows a portable computer 1, which is an example of an electronic apparatus. The portable computer 1 comprises a computer main body 2, and a display unit 3 supported by the computer main body 2. The computer main body 2 has an enclosure 4. The enclosure 4 has the geometry of a flat box having a bottom wall 4*a*, left and right side walls 4*b* and 4*c*, and an upper wall 4*d*. A keyboard support section 5 is formed on the upper wall 4*d*. The keyboard support section 5 supports a keyboard 6.

The display unit 3 comprises a display housing 8, and a liquid crystal display device 9 contained in the display housing 8. The display unit 3, which is connected to a rear end of the enclosure 4 by way of an unillustrated hinge, is pivotable between a closed position and an open position. At the closed position, the display unit 3 is laid on the enclosure 4 in such a manner as to cover the keyboard 6 from above. At the open position, the display unit 3 stands from the rear end of the enclosure 4 in such a manner as to expose the keyboard 6.

As shown in FIG. 1, the enclosure 4 contains a first printed wiring board 11 and a second printed wiring board 12. The first and second printed wiring boards 11 and 12 respectively support a plurality of circuit components 13, such as a semiconductor package. The first and second printed wiring boards 11 and 12 are supported on the bottom wall 4*a* of the enclosure 4, as well as arranged in parallel with the bottom wall 4*a*. Furthermore, a portion of the first printed wiring board 11 and a portion of the second printed wiring board 12 face each other with a gap therebetween in the thickness direction of the enclosure 4.

Figure 2:
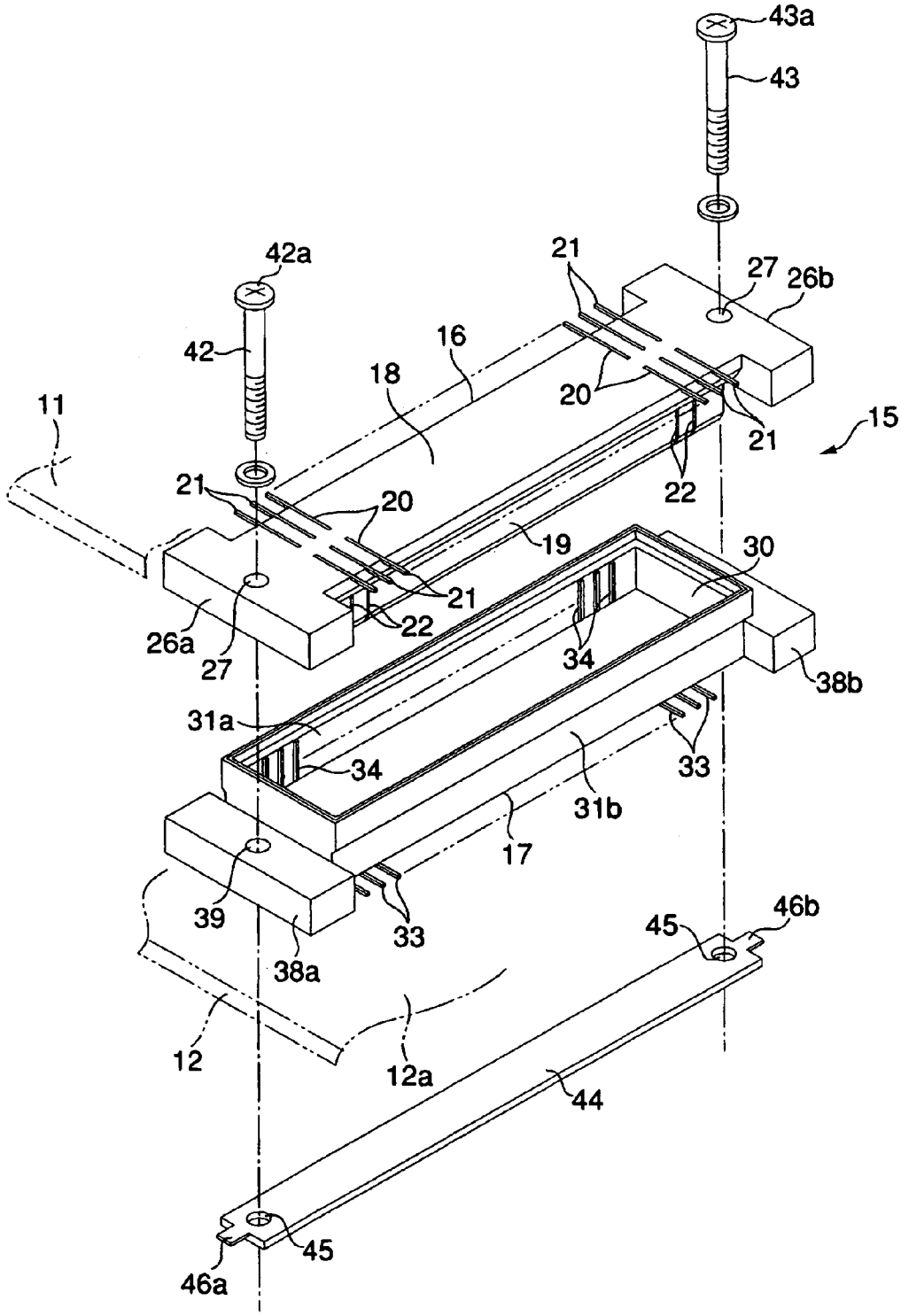
FIG. 2 is a perspective view of a connector of the first embodiment of the invention, showing a positional relationship among a first connector body, a second connector body, screw members, and a nut plate.
Figure 3:
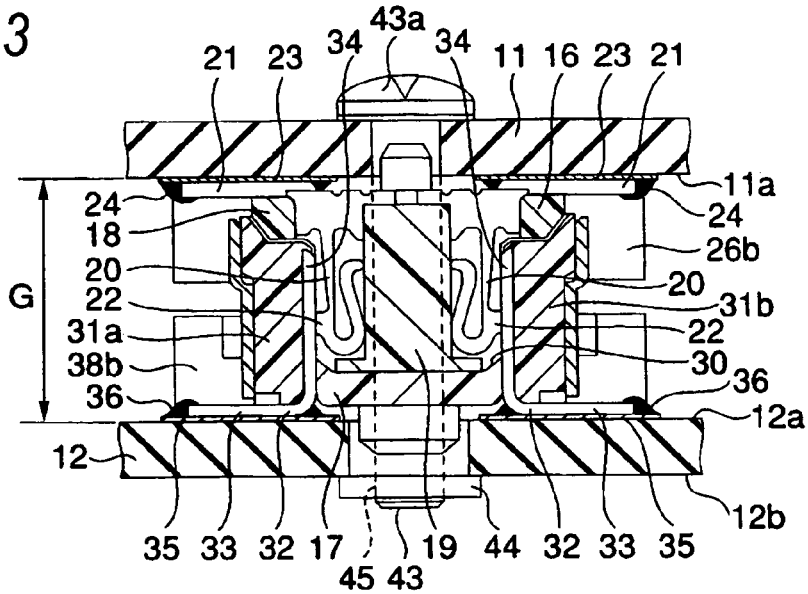
FIG. 3 is a cross-sectional view of the connector of the first embodiment of the invention, showing that the first connector body and the second connector body are fitted together, whereby the first and second printed wiring boards are electrically connected together by way of first and second lead terminals.
Figure 4:
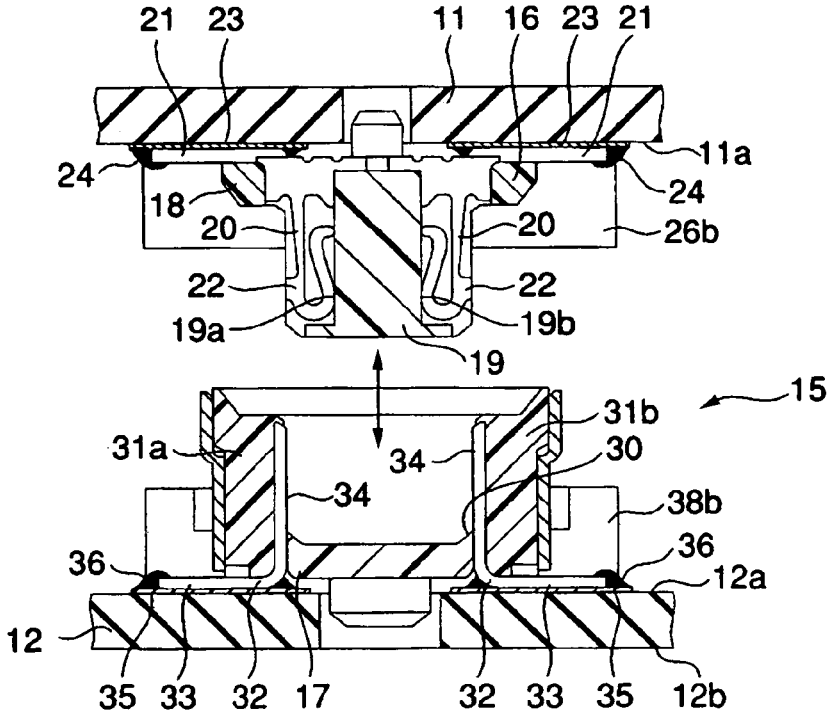
FIG. 4 is a cross-sectional view of the connector of the first embodiment of the invention, showing that the first connector body and the second connector body are separated from each other.

A stacking connector 15 serving as a connector unit is interposed between the first printed wiring board 11 and the second printed wiring board 12. The stacking connector 15, which electrically connects the first printed wiring board 11 and the second printed wiring board 12, has a first connector body 16 serving as a plug portion and a second connector body 17 serving as a socket portion as shown in FIGS. 2 to 4.

The first connector body 16, formed from a synthetic resin, is mounted on a lower face 11*a* of the first printed wiring board 11. The first connector body 16 has a base 18 and terminal support section 19. The base has the geometry of a strip extending along the lower face 11*a* of the first printed wiring board 11. The terminal support section 19 projects downward from the base 18, and extends along the longitudinal direction of the base 18.

The terminal support section 19 has a pair of side faces 19*a* and 19*b*. The side faces 19*a* and 19*b* are arranged along the longitudinal direction of the terminal support section 19 in parallel with each other. The terminal support section 19 supports a plurality of first lead terminals 20. The first lead terminals 20 are aligned in a row along the side surfaces 19*a* and 19*b* of the terminal support section 19 with an interval therebetween.

Each of the first lead terminals 20 is formed from a metal material, for instance, a metal material predominantly composed of copper. The surface of the first lead terminal 20 is covered with a gold plating layer. The first lead terminal 20 has first sections 21 and second sections 22. The first sections 21 have the geometry of a pin of a size conforming to pads 23 located on the lower face 11*a* of the first printed wiring board 11. The first sections 21 are arranged so as to extend from opposite side sections of the base 18 along the lower face 11*a* of the first printed wiring board 11. The second sections 22 are exposed on the side faces 19*a* and 19*b* of the terminal support section 19, and have such elasticity as to be capable of elastic deformation in the direction approaching and departing to and from the side face 19*a* and 19*b*.

The first sections 21 of the first lead terminal 20 are soldered onto the pads 23 on the first printed wiring board 11, whereby fillets 24 is formed between the pads 23 and the first sections 21. By means of soldering, the pads 23 and the first lead terminal 20 are electrically connected together, and the first connector body 16 is mechanically retained on the first printed wiring board 11.

As shown in FIG. 2, the first connector body 16 has a pair of screw-receiving sections 26*a* and 26*b*. The screw-receiving sections 26*a* and 26*b* are located on opposite longitudinal ends of the terminal support section 19, and are spaced from each other with the terminal support section 19 therebetween. The screw-receiving section 26*a* and 26*b* respectively overlap the lower face 11*a* of the first printed wiring board 11, and have through holes 27 at the center thereof. Each of the through holes 27 is continuous with an insertion hole 28 formed in the first printed wiring board 11.

The second connector body 17, formed from a synthetic resin, is mounted on an upper face 12*a* of the second printed wiring board 12. The second connector body 17 has the geometry of an elongated rectangular solid, and has a fitting recess 30 which is open upward. In the fitting recess 30, the terminal support section 19 of the first connector body 16 is removably fit. As a result of this fitting, the first connector body 16 and the second connector body 17 are integrally joined together.

The fitting recess 30 has a pair of side walls 31*a* and 31*b* serving as terminal support sections. The side walls 31*a* and 31*b* face each other, and extend in the longitudinal direction of the second connector body 17. The side walls 31*a* and 31*b* respectively support a plurality of second lead terminals 32. The second lead terminals 32 are formed from a metal material, for instance, a metal material predominantly composed of copper. The surface of the second lead terminals 32 are covered with gold plating layers.

The second lead terminal 32 has first sections 33 and second sections 34. The first sections 33 have the geometry of a pin of a size conforming to pads 35 disposed on the upper face 12*a* of the second printed wiring board 12. The first sections 33 are arranged so as to extend from opposite side sections of the second connector body 17 along the upper face 12*a* of the second printed wiring board 12. The second sections 34 have the geometry of a pin extending in the direction perpendicular to the first sections 33. The second sections 34 are aligned in a row along inner faces of the side walls 31*a* and 31*b* of the fitting recess 30. Accordingly, the second sections 34 of the second lead terminals 32 are exposed to the fitting recess 30.

As shown in FIGS. 3 and 4, the second sections 33 of the second lead terminal 32 are soldered onto the pads 35 on the upper face 12*a* of the second printed wiring board 12, whereby fillets 36 are formed between the pads 35 and the first section 33, By means of soldering, the pads 35 and the second lead terminal 32 are electrically connected together, and the second connector body 17 is mechanically retained on the second printed wiring board 12.

As shown in FIG. 2, the second connector body 17 has a pair of screw-receiving sections 38*a* and 38*b*. The screw-receiving sections 38*a* and 38*b* are located at opposite longitudinal ends of the second connector body 17 and are spaced from each other with the fitting recess 30 therebetween. The screw-receiving section 38*a* and 38*b* respectively overlap the upper face 12*a* of the second printed wiring board 12, and have through holes 39 at the center thereof. Each of the through holes 39 is continuous with an insertion hole 40 formed in the second printed wiring board 12.

When the terminal support section 19 of the first connector body 16 is fitted in the fitting recess 30 of the second connector body 17, the second sections 22 of the first lead terminals 20 and the second sections 34 of the second lead terminals 32 are brought into contact with each other. In particular, since the second sections 22 of the first lead terminals 20 have elasticity, contact pressure between the first lead terminals 20 and the second lead terminals 32 can be ensured. Accordingly, as a result of occurrence of a contact between the first and second lead terminals 20 and 32, the first printed wiring board 11 and the second printed wiring board 12 are electrically connected.

Furthermore, as shown in FIG. 3, in a state in which the terminal support section 19 is fitted in the fitting recess 30, a tip of the terminal support section 19 impinges on the bottom of the fitting recess 30. As a result, a gap G between the first printed wiring board 11 and the second printed wiring board 12 is set to a predetermined value.

Accordingly, the screw-receiving sections 26*a*, 26*b* of the first connector body 16, and the screw-receiving sections 38*a*, 38*b* of the second connector body 17 face each other with a fit portion between the terminal support section 19 and the fitting recess 30 therebetween. As a result, as shown in FIG. 5, the insertion hole 28 in the first printed wiring board 11, the through hole 27 in the first connector body 16, the through hole 39 in the second connector body 17, and the insertion hole 40 in the second printed wiring board 12 are coaxially aligned in a row.

In a state where the first connector body 16 and the second connector body 17 are fitted together, the stacking connector 15 configured as above is coupled to the first and second printed wiring boards 11 and 12 by way of a pair of fixing screws 42 and 43 serving as screw members, and a nut plate 44 serving as a fastening member.

Figure 5:
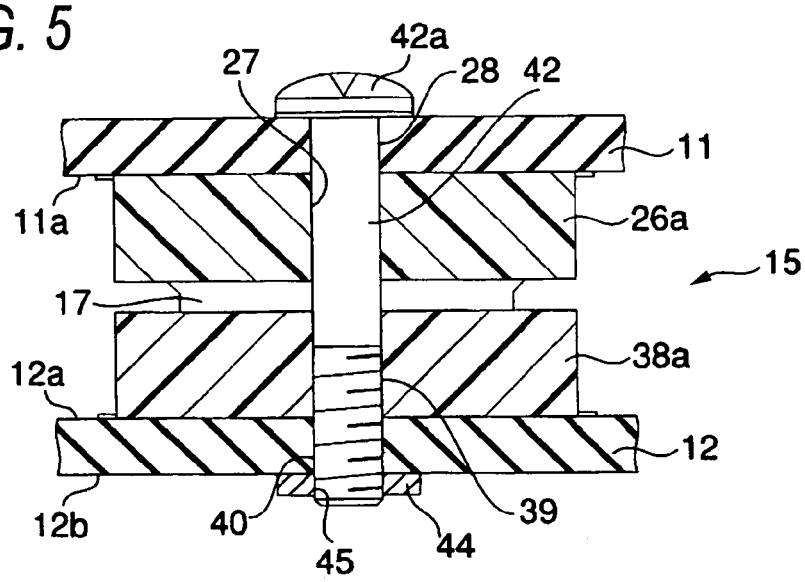
FIG. 5 is a cross-sectional view of the connector of the first embodiment of the invention, showing that the first and second connector bodies are integrally fastened between the first printed wiring board and the second printed wiring board.

As shown in FIGS. 2 and 5, the fixing screw 42 and 43 are respectively inserted through the insertion holes 28 from above the first printed wiring board 11. The fixing screws 42 and 43 are arranged so as to continually pass through the through holes 27 in the screw-receiving section 26*a*, 26*b*; the through holes 39 in the screw-receiving section 38*a*, 38*b*; and the insertion holes 40 in the second printed wiring board 12.

The nut plate 44 has the geometry of a strip extending in the longitudinal direction of the second connector body 17. The nut plate 44 has a pair of screw holes 45, and overlaps a lower face 12*b* of the second printed wiring board 12. The screw holes 45 are spaced from each other in the longitudinal direction of the nut plate 44 so as to conform to the insertion holes 40 in the second printed wiring board 12.

In addition, the nut plate 44 has a pair of anchor sections 46*a* and 45*b*. The anchor sections 46*a* and 46*b* are located at opposite ends spaced in the longitudinal direction of the nut plate 44. The anchor section 46*a* and 46*b* are temporarily fixed to the lower face 12*b* of the second printed wiring board 12 by means of, for instance, soldering. As a result of the temporal fixation, the screw holes 45 are brought into communication with the insertion holes 40 in the second printed wiring board 12.

The fixing screws 42 and 43 are caused to pass through the first and second printed wiring boards 11 and 12, and the first and second connector bodies 16 and 17; and thereafter screwed into the screw holes 45 in the nut plate 44. As a result of this screwing-in, the first and second printed wiring boards 11 and 12, and the first and second connector bodies 16 and 17 are integrally pinched between heads 42*a*, 43*a* of the fixing crews 42, 43, and the nut plate 44. Put another way, when the fixing screws 42 and 43 are screwed in, the first printed wiring board 11, the second printed wiring board 12, the first connector body 16, and the second connector body 17 receive a load for restraining relative movement therebetween.

Next, processes for electrically connecting the first printed wiring board 11 to the second printed wiring board 12 with use of the stacking connector 15 will be described.

First, the first lead terminals 20 of the first connector body 16 are soldered onto the pads 23 on the first printed wiring board 11, thereby mounting the first connector body 16 on the lower face 11*a* of the first printed wiring board 11. Similarly, the second lead terminals 32 of the second connector body 17 are soldered onto the pads 35 on the second printed wiring board 12, thereby mounting the second connector body 17 on the upper face 12*a* of the second printed wiring board 12.

Next, the terminal support section 19 of the first connector body 16 is fitted in the fitting recess 30 of the second connector body 17. Hence, a gap G between the first printed wiring board 11 and the second printed wiring board 12 is set. Accordingly, the second sections 22 of the first lead terminals 20 and the second sections 34 of the second lead terminals 32 are brought into contact with each other, thereby electrically connecting the first printed wiring board 11 to the second printed wiring board 12 by way of the first and second lead terminals 20 and 32.

Next, the fixing screws 42 and 43 are inserted through the insertion holes 28 in the first printed wiring board 11 from above. Subsequently, the fixing screws 42 and 43 are caused to continually pass through the through holes 27 in the first connector body 16, the through holes 39 in the second connector body 17, and the insertion holes 40 in the second printed wiring board 12.

Finally, penetrating edges of the fixing screws 42 and 43 are screwed into the screw holes 45 in the nut plate 44. As a result of this screwing-in, the first printed wiring board 11 and the second printed wiring board 2, and the first connector body 16 and the second connector body 17 are integrally fastened together. Consequently, a load for restraining relative movement between the first printed wiring board 11, the second printed wiring board 12, and the stacking connector 15 is applied, whereby the operation for electrically connecting the first printed wiring board 11 to the second printed wiring board 12 is completed.

According to the first embodiment of the invention, the first printed wiring board 11, the second printed wiring board 12, the first connector body 16, and the second connector body 17 can be restrained firmly so as to prevent occurrence of relative movements therebetween.

Therefore, when, for instance, a strong impact, or stress resulting from a difference in thermal expansion is exerted on the fit portion between the first connector body 16 and the second connector body 17, the fixing screws 42 and 43 can receive much of this impact and stress. Accordingly, stress applied an the soldered portions between the first and second lead terminals 20, 32 and the pads 23, 35; and that applied on the contact portions between the first lead terminals 20 and the second lead terminals 32 can be reduced.

Accordingly, damage which may otherwise be inflicted on the soldered portions of the first and second lead terminals 20 and 32 can be prevented; and a favorable contact between the first and second lead terminals 20 and 32 can be maintained. Hence, reliability of electric connection of the stacking connector 15 is enhanced.

In addition, according to the first embodiment, the nut plate 44 is temporarily fixed to the lower face 12*b* of the second printed wiring board 12 prior to screwing-in of the fixing screws 42 and 43. Therefore, a necessity for holding the nut plate 44 by hand at the time of fastening the fixing screws 42 and 43 is negated, thereby facilitating fastening work of the fixing screws 42 and 43.

Meanwhile, in the first embodiment, the fixing screws are inserted from the first printed wiring board toward the second printed wiring board; however, the invention is not limited thereto. For instance, the fixing screws may be inserted from the second printed wiring board toward the first printed wiring board. In this case, the nut plate is temporarily fixed to the first printed wiring board.

Figure 6:
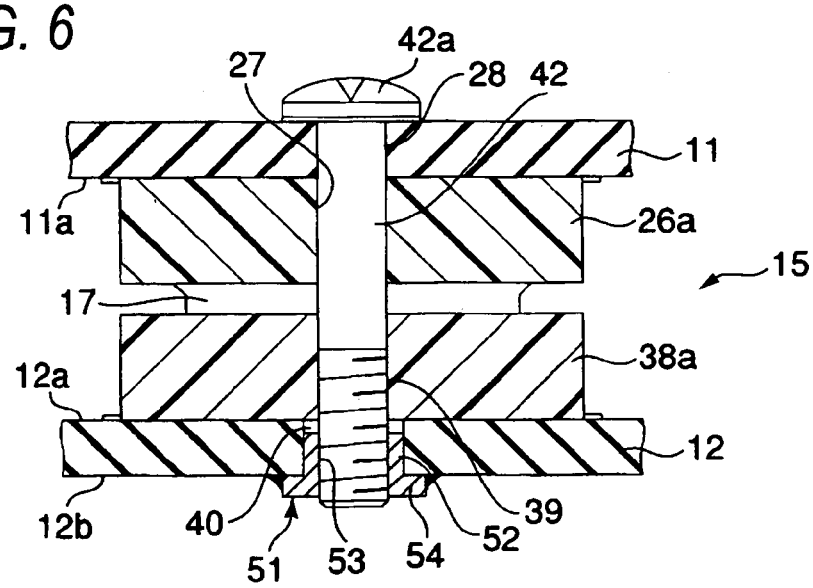
FIG. 6 is a cross-sectional view of a connector of a second embodiment of the invention, showing that a first and second connector bodies are integrally fastened between a first printed wiring board and a second printed wiring board.
Figure 7:
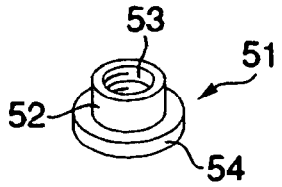
FIG. 7 is a perspective view of a nut for use in the second embodiment of the invention.

FIGS. 6 and 7 show a second embodiment of the invention.

In the second embodiment, a nut 51 is employed as a fastening member. However, in other respects, the stacking connector 15 is identical in configuration with that of the first embodiment. Hence, elements identical with those of the first embodiment are denoted by the same reference numerals, and repeated descriptions are omitted.

FIG. 6 shows a coupling portion between the screw-receiving section 26*a* of the first connector body 16 and the screw-receiving section 38*a* of the second connector body 17. The nut 51 has a cylinder section 52 to be fitted in the insertion hole 40 in the second printed wiring board 12. A female thread 53 is formed in an inner face of the cylinder section 52.

The cylinder section 52 has a flange 54. The flange 54 projects radially outward from one end of the cylinder section 52, and overlaps the lower face 12*h* of the second printed wiring board 12. A periphery of the flange 54 is fixedly mounted directly on the lower face 12*b* of the second printed wiring board 12 by means of soldering, or the like.

The fixing screw 42, which continually passes through the first and second printed wiring boards 11 and 12, and the first and second connector bodies 16 and 17, is screwed into the female thread 53 in the nut 51. As a result of this screwing action, a load for restraining relative movement between the first printed wiring board 11, the second printed wiring board 12, the first connector body 16, and the second connector body 17 can be applied, thereby yielding the same effect as that yielded in the first embodiment.

Figure 8:
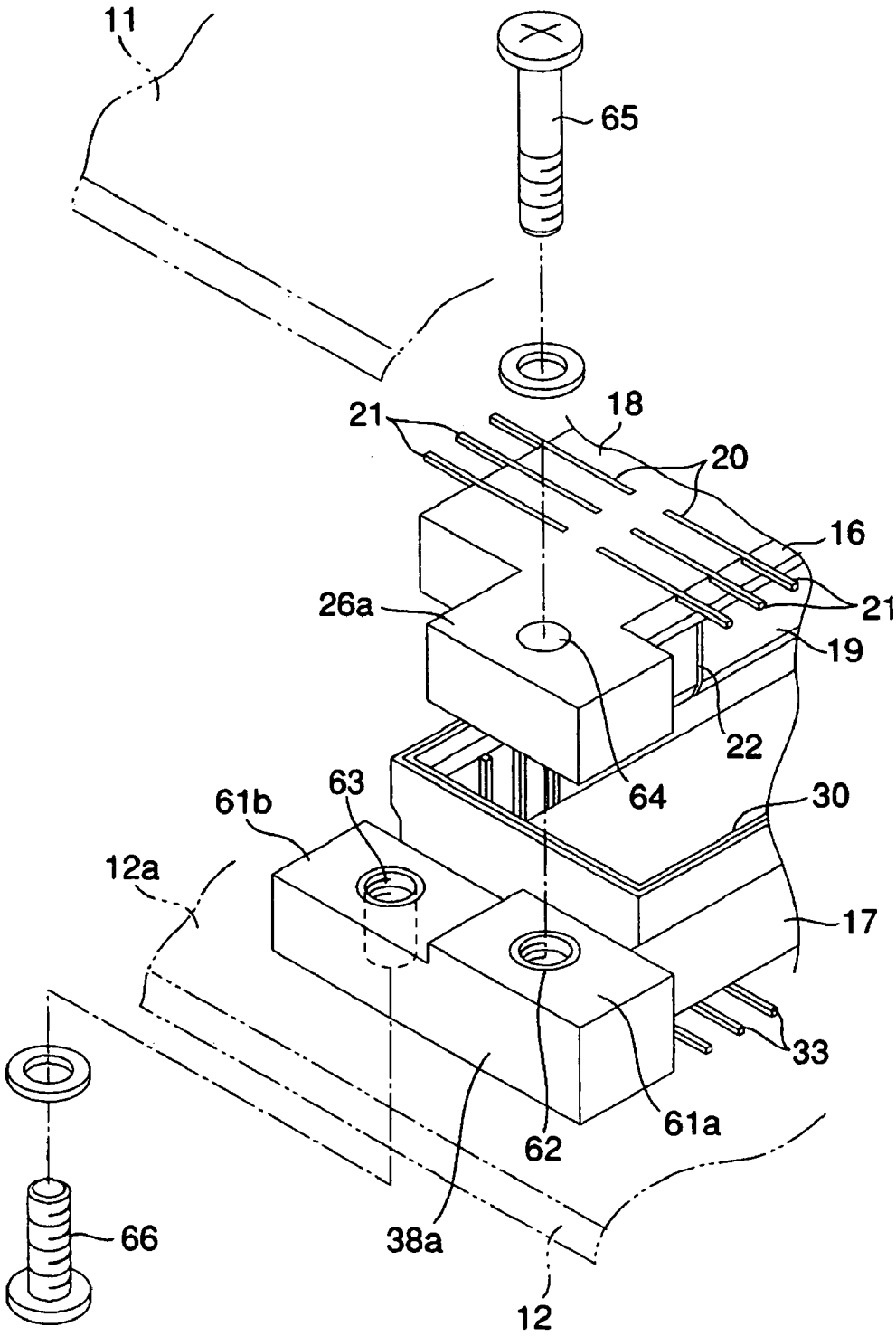
FIG. 8 is a perspective view of a connector of a third embodiment of the invention, showing a positional relationship among a first connector body, a second connector body, a first screw member, and a second screw member.
Figure 9:
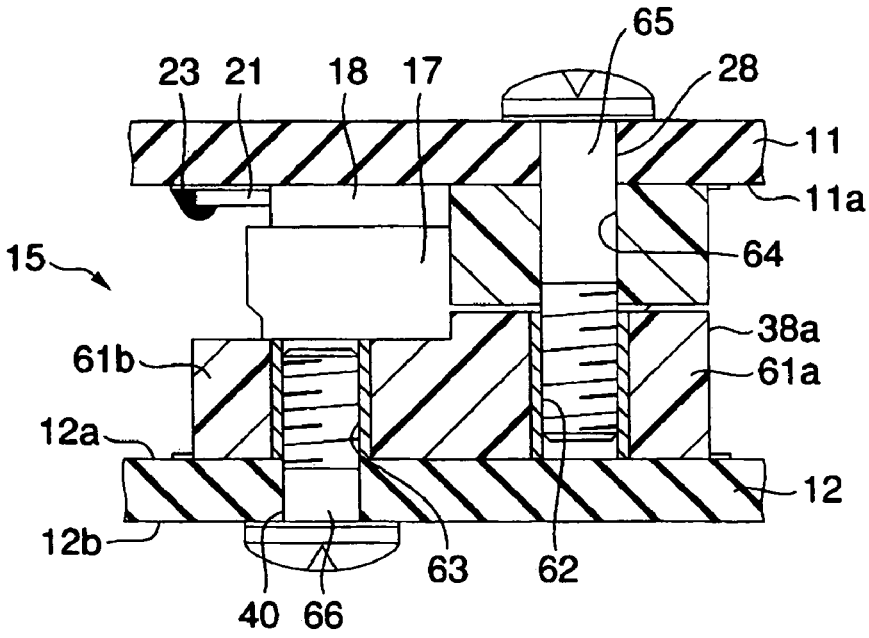
FIG. 9 is a cross-sectional view of the connector of the third embodiment of the invention, showing that the first and second connector bodies are integrally fastened between a first printed wiring board and a second printed wiring board.

FIGS. 8 and 9 show a third embodiment of the invention.

The third embodiment differs from the first embodiment in configuration of restraint for preventing relative movement between the first printed wiring board 11, the second printed wiring board 12, and the stacking connector 15. In other respects, the stacking connector 15 is identical in basic configuration with that of the first embodiment.

FIG. 8 shows the screw-receiving sections 26*a* and 38*a* of the first and second connector bodies 16 and 17. The screw-receiving section 38*a* of the second connector body 17 has a first section 61*a* and a second section 61*b*. The first and second sections 61*a* and 61*b* are aligned in a direction crossing the longitudinal direction of the second connector body 17.

A first screw hole 62 is formed in the first section 61*a* of the screw-receiving section 38*a*. The first screw hole 62 is continuous with the insertion hole 28 in the first printed wiring board 11. A second screw hole 63 is formed in the second section 61*b* of the screw-receiving section 38*a*. The second screw hole 63 is continuous with the insertion hole 40 in the second printed wiring board 12. Therefore, in the present embodiment, the insertion hole 28 in the first printed wiring board 11 and the insertion hole 40 in the second printed wiring board 12 are offset in the direction crossing the longitudinal direction of the first and second connector body 16, 17.

The screw-receiving section 26*a* of the first connector body 16 is interposed between the first section 61*a* of the screw-receiving section 38*a* and the lower face 11*a* of the first printed wiring board 11. The screw-receiving section 26*a* has a through hole 64. The through hole 64 in the screw-receiving section 26*a*, the insertion hole 28 in the first printed wiring board 11, and the first screw hole 62 in the first screw-receiving section 61*a* are coaxially aligned in a row.

The first printed wiring board 11, the first connector body 16, and the second connector body 17 are fastened together by way of the first fixing screw 65 serving as a first fastening member. The first fixing screw 65 is inserted through the insertion hole 28 and in the through hole 64 from above the first printed wiring board 11; and a penetrating end of the first fixing screw 65 is screwed into the first screw hole 62.

The second printed wiring board 12 and the second connector body 17 are fastened together by way of the second fixing screw 66 serving as a second fastening member. The second fixing screw 66 is inserted through the insertion hole 40 from below the second printed wiring board 12; and a penetrating end of the second fixing screw 66 is screwed into the second screw hole 63.

The process for electrically connecting the first and second printed wiring boards 11 and 12 to each other with use of the stacking connector 15 having the above-described configuration will be described.

The process from a step of soldering the first and second connector bodies 16 and 17 onto the first and second printed wiring boards 11 and 12, to a step of fitting the first and second connector bodies 16 and 17 each other is analogous to that of the first embodiment.

After completion of fitting of the first and second connector bodies 16 and 17, the first fixing screw 65 is inserted through the insertion hole 28 in the first printed wiring board 11 from above; and is screwed into the first screw hole 62 in the second connector body 17. In conjunction therewith, the second fixing screw 66 is inserted through the insertion hole 40 in the second printed wiring board 12 from below; and is screwed into the second screw hole 63 in the second connector body 17.

As a result of this screwing-in, the first connector body 16 is coupled to the first printed wiring board 11, and the second connector body 17 is coupled to the second printed wiring board 12; and the first and second connector bodies 16 and 17 are integrally fastened together between the first and second printed wiring boards 11 and 12.

Consequently, a load for restraining relative movement between the first printed wiring board 11, the second printed wiring board 12, and the stacking connector 15 is applied, whereby the operation for electrically connecting the first printed wiring board 11 to the second printed wiring board 12 is completed.

Figure 10:
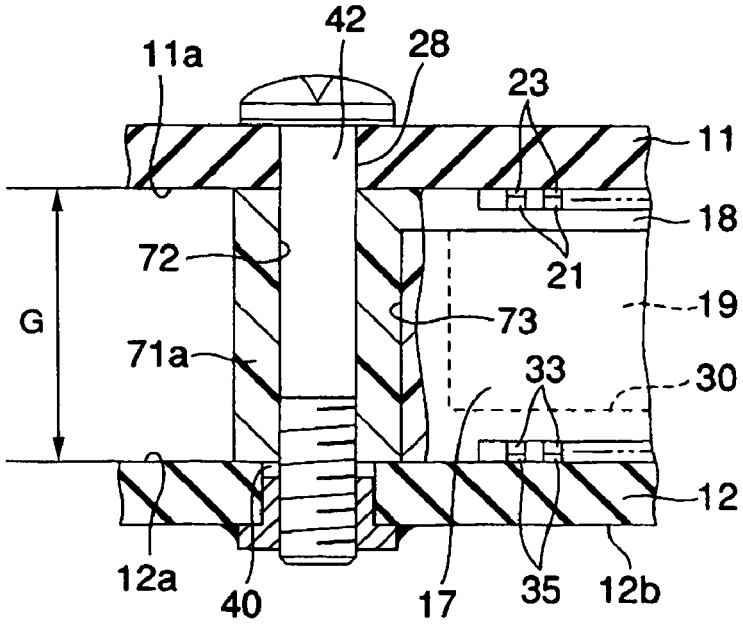
FIG. 10 is a cross-sectional view of a connector of a fourth embodiment of the invention, showing that the first and second connector bodies are integrally fastened between a first printed wiring board and a second printed wiring board.
Figure 11:
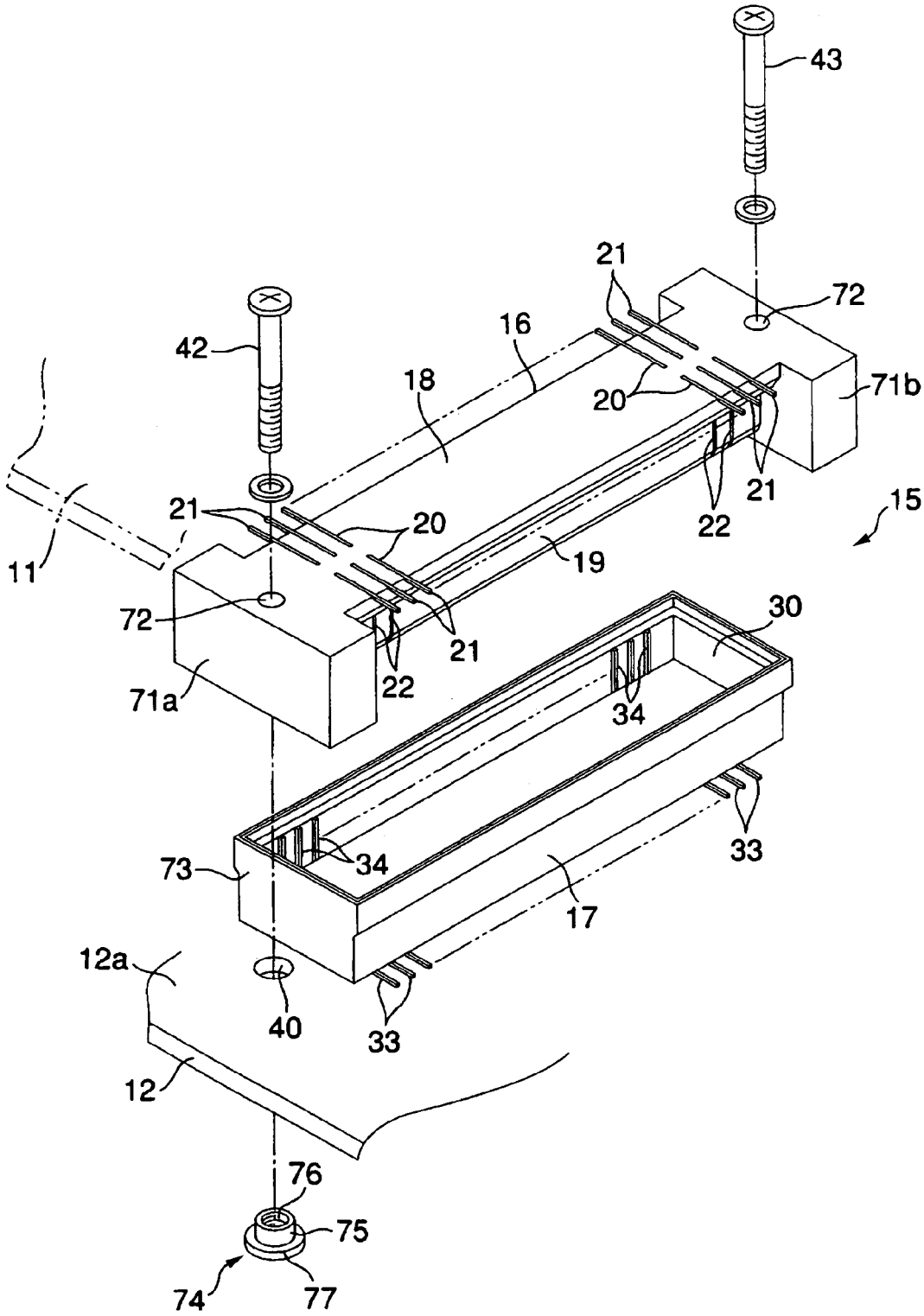
FIG. 11 is a perspective view of a connector of the fourth embodiment of the invention, showing a positional relationship among a first connector body, a second connector body, screw members, and a nut.

FIGS. 10 and 11 show a fourth embodiment of the invention.

The fourth embodiment differs from the first embodiment in configuration of restraint for preventing relative movement between the first printed wiring board 11, the second printed wiring board 12, and the stacking connector 15. In other respects, the stacking connector 15 is identical in basic configuration with that of the first embodiment.

As shown in FIG. 11, the first connector body 16 has a pair of spacer sections 71*a* and 71*b*. The spacer sections 71*a* and 71*b* are located at opposite longitudinal ends of the terminal support section 19, and are spaced from each other with the terminal support section 19 therebetween. The spacer sections 71*a* and 71*b* are interposed between the lower face 11*a* of the first printed wiring board 11 and the upper face 12*a* of the second printed wiring board 12, thereby defining the gap G between the first printed wiring board 11 and the second printed wiring board 12.

The spacer sections 71*a* and 71*b* respectively have through holes 72 at the center thereof. Each of the through hole 72 is formed coaxially with the insertion hole 28 in the first printed wiring board 11 and the insertion hole 40 in the second printed wiring board 12.

The second connector body 17 has a pair of end faces 73 (only one end face 73 is shown in the drawing). The end faces 73 are located at opposite longitudinal ends of the second connector body 17; and stand upright from the upper face 12*a* of the second printed wiring board 12.

In a state where the first connector body 16 and the second connector body 17 are fitted together, the end faces 73 of the second connector body 17 are brought into contact with the spacer sections 71*a* and 71*b* of the first connector body 16. Therefore, the second connector body 17 is interposed between the spacer sections 71*a* and 71*b* of the first connector body 16, thereby being pinched by the spacer sections 71*a* and 71*b*.

The first printed wiring board 11, the second printed wiring board 12, and the first connector body 16 are integrally fastened together by way of the fixing screws 42 and 43, and a nut 74 serving as a fastening member. The fixing screw 42 and 43 are respectively inserted through the insertion holes 23 from above the first printed wiring board 11. The fixing screws 42, 43 are arranged so as to continually pass through the through holes 72 in the spacer sections 71*a*, 71*b*, and the insertion holes 40 in the second printed wiring board 12.

The nut 74 has a cylinder section 75 to be fitted in the insertion hole 40 in the second printed wiring board 12. A female thread 76 is formed in an inner face of the cylinder section 75. In addition, the cylinder section 75 has a flange 77. The flange 77 projects radially outward from an end of the cylinder section 75, and overlaps the lower face 12*b* of the second printed wiring board 12. A periphery of the flange 77 is fixedly mounted directly on the lower face 12*b* of the second printed wiring board 12 by means of soldering, or the like.

The fixing screws 42, 43, which continually pass through the first and second printed wiring boards 11 and 12, and the spacer sections 71*a*, 71*b*, are screwed into the female threads 76 in the nuts 74. As a result of this screwing-in, the first and the second connector bodies 16 and 17 are integrally fastened between the first printed wiring board 11 and the second printed wiring board 12.

The process for electrically connecting the first and second printed wiring boards 11 and 12 to each other with use of the stacking connector 15 configured as above will be described.

The process from a step of soldering the first and second connector bodies 16 and 17 onto the first and second printed wiring boards 11 and 12, to a step of fitting together the first and second connector bodies 16 and 17 is analogous to that of the first embodiment.

When the first connector body 16 and the second connector body 17 are fitted together, the second connector body 17 is pinched between the spacer sections 71*a* and 71*b* of the first connector body 16. This pinching maintains a firm fitted state between the first connector body 16 and the second connector body 17.

In conjunction therewith, the spacer sections 71*a* and 71*b* are interposed between the lower face 11*a* of the first printed wiring board 11 and the upper face 12*a* of the second printed wiring board 12, thereby setting the gap G between the first printed wiring board 11 and the second printed wiring board 12.

Next, the fixing screws 42, 43 are inserted through the insertion holes 28 in the first printed wiring board 11 from above. The fixing screws 42, 43 pass through the through holes 72 in the spacer sections 71*a*, 71*b*; and are screwed into the female threads 76 in the nuts 74. By means of this screwing action, the first and the second connector bodies 16 and 17, which are fitted together between the first printed wiring board 11 and the second printed wiring board 12, are integrally fastened together.

Consequently, a load for restraining relative motion between the first printed wiring board 11, the second printed wiring board 12, and the stacking connector 15 is applied, whereby the operation for electrically connecting the first printed wiring board 11 and the second printed wiring board 12 to each other is completed.

Meanwhile, in the fourth embodiment, the spacer sections are disposed on the first connector body. However, the invention is not limited thereto. For instance, the spacer sections may be disposed on the second connector body; and the nut may be fixedly mounted directly on the first printed wiring board.

Figure 12:
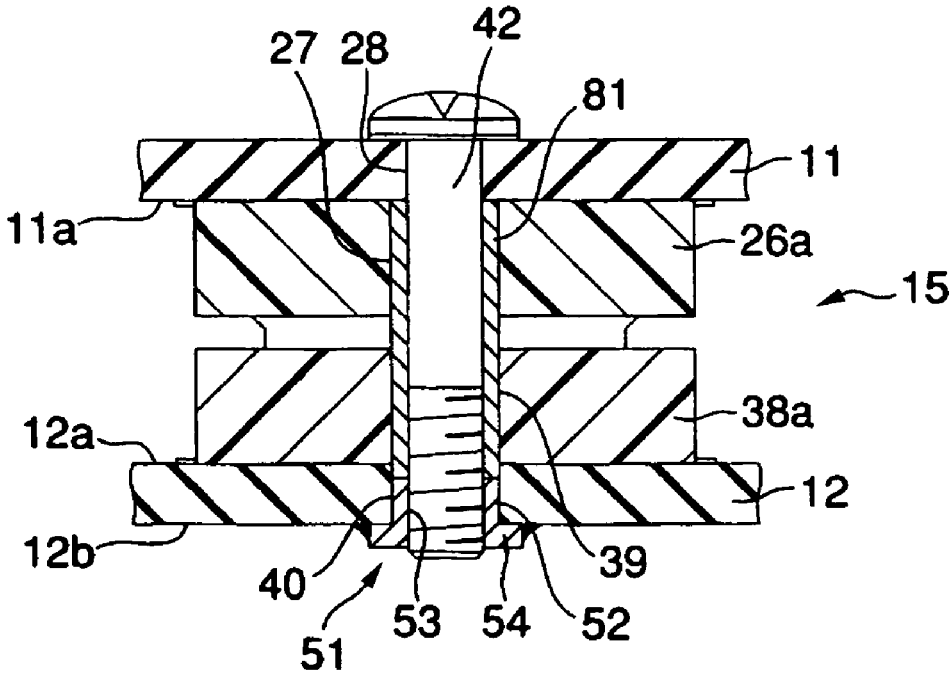
FIG. 12 is a cross-sectional view of a connector of a fifth embodiment of the invention, showing that first and second connector bodies are integrally fastened between a first printed wiring board and a second printed wiring board.
Figure 13:
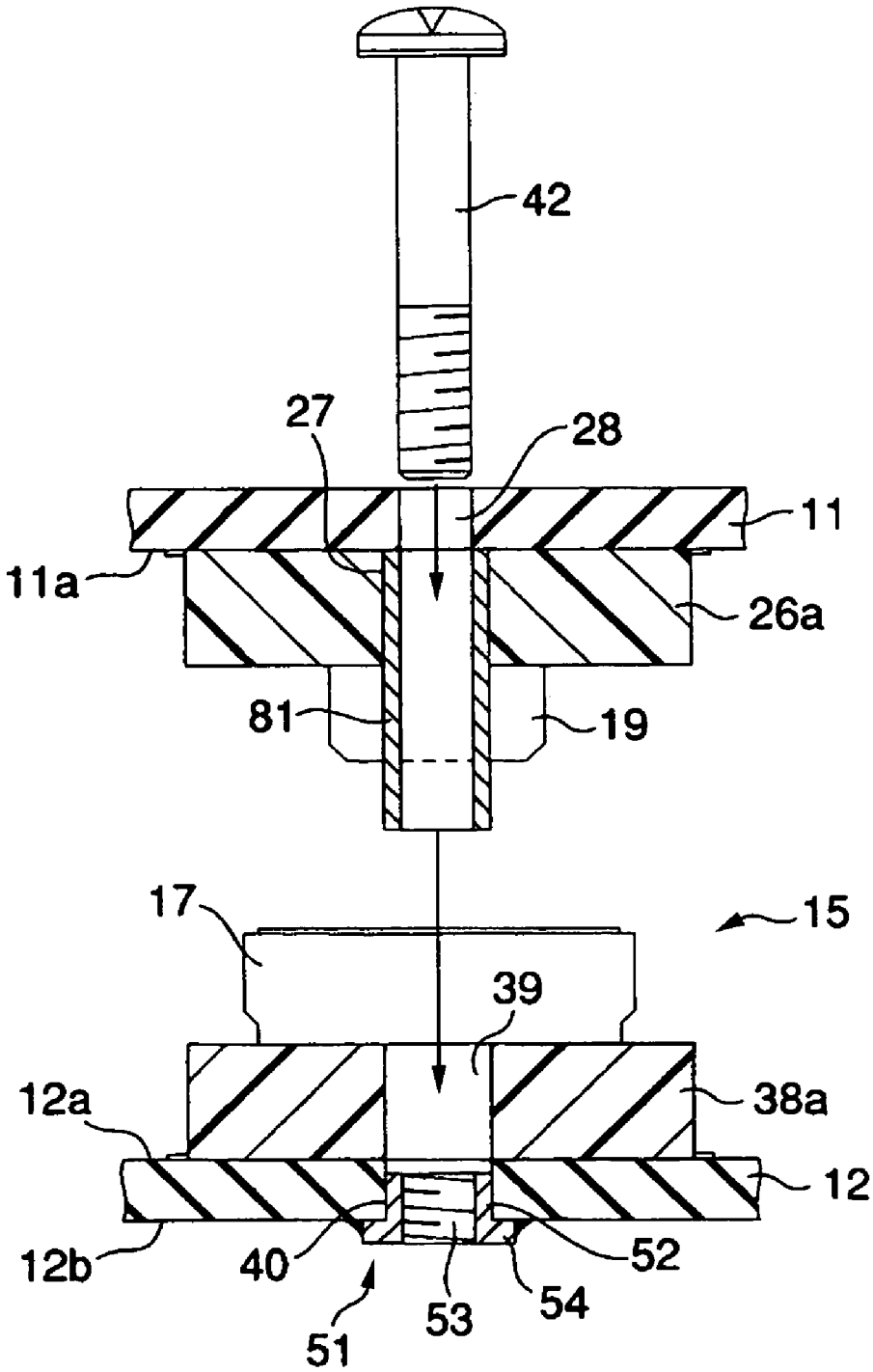
FIG. 13 is a perspective view of the connector of the fifth embodiment of the invention, showing a positional relationship among the first connector body, the second connector body, screw members, and a nut.

FIGS. 12 and 13 show a fifth embodiment of the invention.

The fifth embodiment is a development of the second embodiment. Hence, elements identical with those of the second embodiment are denoted by the same reference numerals, and repeated descriptions are omitted.

FIGS. 12 and 13 disclose a coupling portion between the screw-receiving section 26*a* of the first connector body 16 and the screw-receiving section 38*a* of the second connector body 17. A guide pipe 81 is fixed in the through hole 27 in the screw-receiving section 26*a* by means of, for instance, press-fit. The guide pipe 81 projects from the screw-receiving section 26*a* of the first connector body 16 toward the screw-receiving section 38*a* of the second connector body 17.

When the first connector body 16 and the second connector body 17 are fitted together, the guide pipe 81 passes through the through hole 39 in the screw-receiving section 38*a*; and a penetrating end of the guide pipe 81 is inserted into the insertion hole in the second printed wiring board 12.

The fixing screw 42 passes through the through hole 28 in the first printed wiring board 11 and the guide pipe 81, and is screwed into the female thread 53 in the nut 51. As a result of this screwing-in, the first printed wiring board 11, the second printed wiring board 12, the first connector body 16, and the second connector body 17 are firmly restrained so as to prevent relative movement therebetween.

Figure 14:
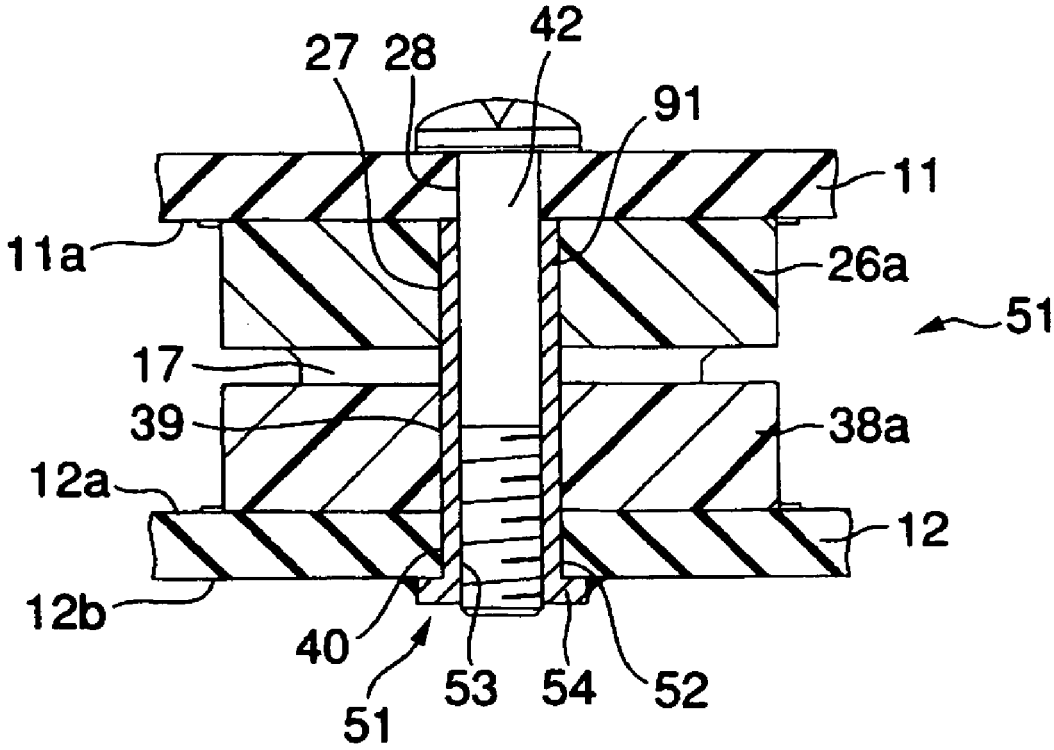
FIG. 14 is a cross-sectional view of a connector of a sixth embodiment of the invention, showing that first and second connector bodies are integrally fastened between a first printed wiring board and a second printed wiring board.
Figure 15:
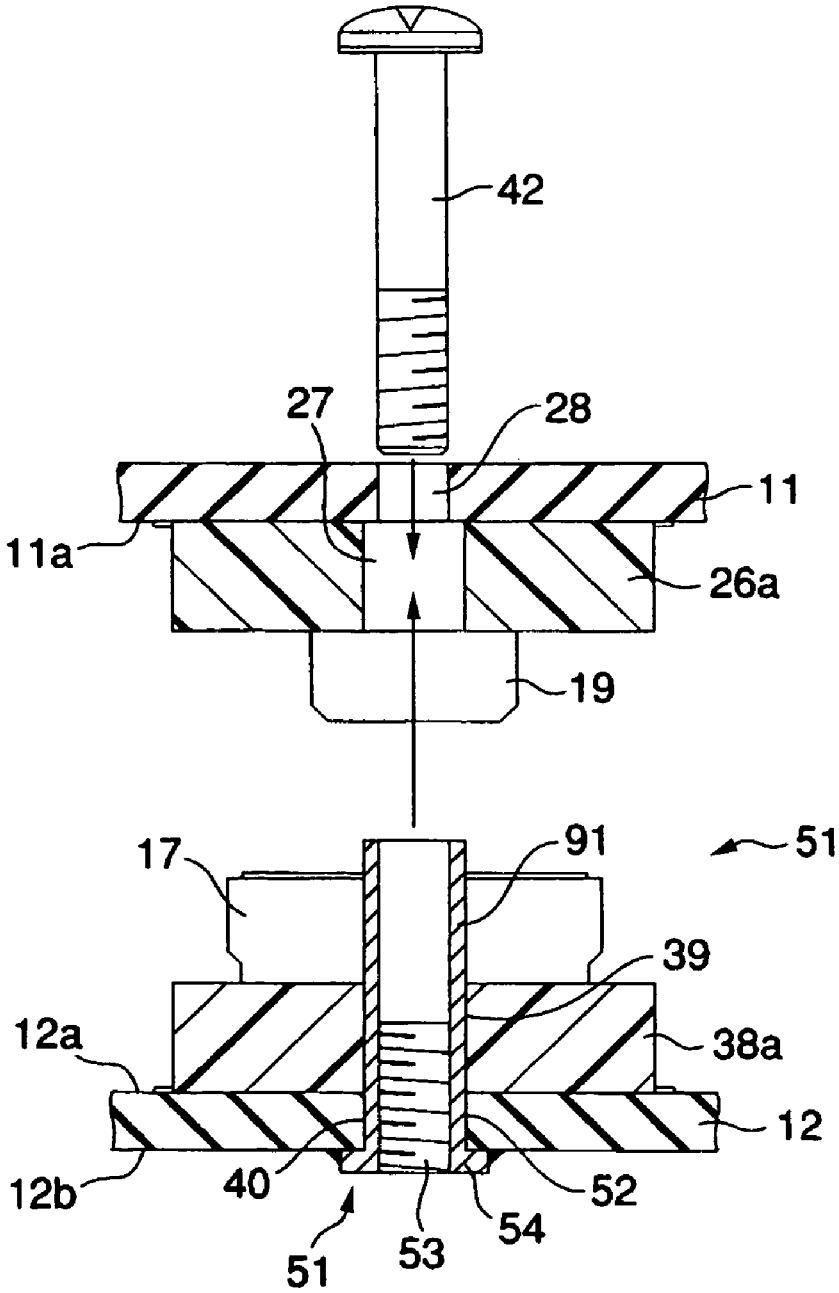
FIG. 15 is a cross-sectional view of the connector of the sixth embodiment of the invention, showing a positional relationship among the first connector body, the second connector body, screw members, and a nut.

FIGS. 14 and 15 show a sixth embodiment of the invention.

The sixth embodiment differs from the second embodiment in configuration of the nut 51. In other respects, the stacking connector 15 is identical in basic configuration with that of the second embodiment.

FIGS. 14 and 15 show a coupling portion between the screw-receiving section 26*a* of the first connector body 16 and the screw-receiving section 38*a* of the second connector body 17. The cylinder section 52 of the nut 51 has a pipe-shaped guide section 91. The guide section 91 is integrated with the cylinder section 52; and projects toward the screw-receiving section 26*a* of the second connector body 17 while passing through the through hole 39 in the screw-receiving section 38*a*. When the first connector body 16 and the second connector body are fit together, the guide section 91 is fit in the through hole 27 in the screw-receiving section 26*a*.

The fixing screw 42 passes through the through hole 28 in the first printed wiring board 11 and the guide section 81, and is screwed into the female thread 53 in the nut 51. As a result of this screwing-in, the first printed wiring board 11, the second printed wiring board 12, the first connector body 16, and the second connector body 17 are firmly restrained so as to prevent relative movement therebetween.

Meanwhile, in the sixth embodiment, the fixing screw may be inserted from the second printed wiring board toward the first printed wiring board; and the nut may be fixedly mounted directly on the first printed wiring board. In this case, the guide section of the nut passes through the screw-receiving section of the first connector body.

Figure 16:
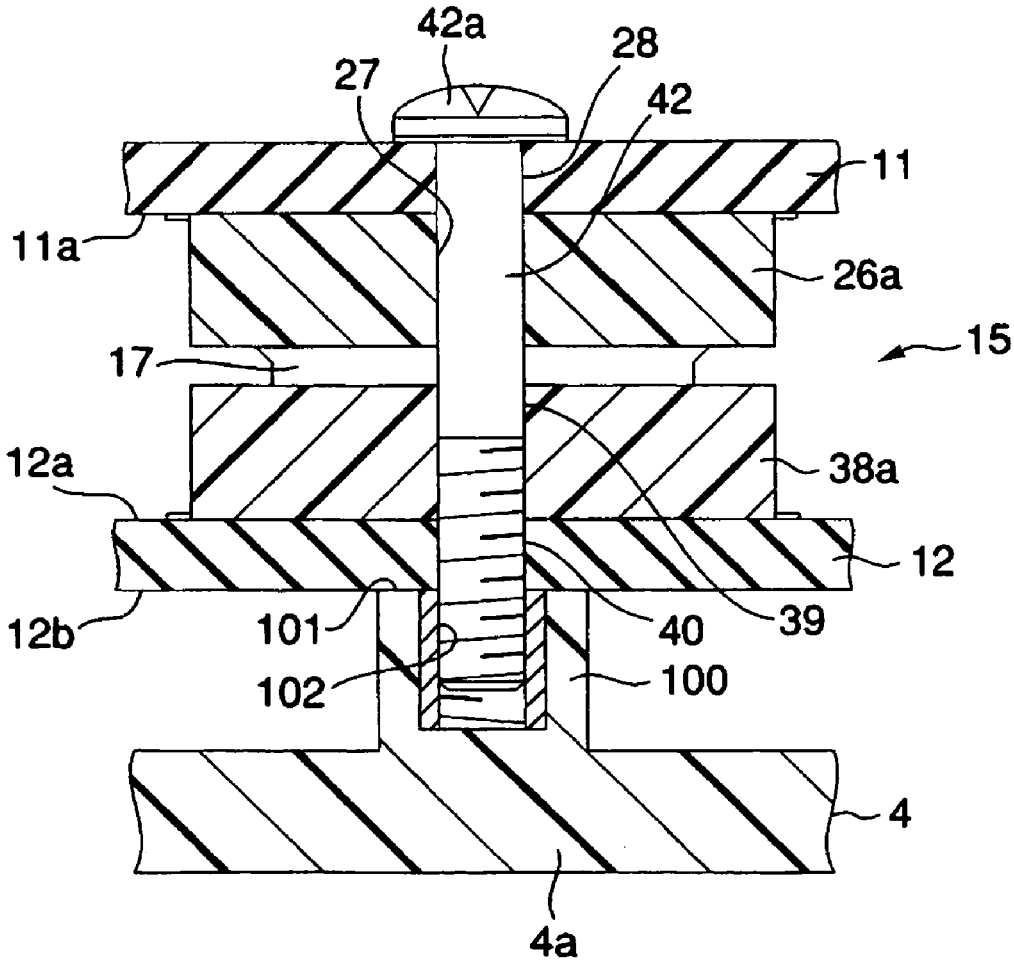
FIG. 16 is a cross-sectional view of a connector of a seventh embodiment of the invention, showing that first and second connector bodies are integrally fastened between a first printed wiring board and a second printed wiring board.

FIG. 16 shows a seventh embodiment of the invention.

The seventh embodiment differs from the first embodiment in that the fixing screw 42 is screwed into the bottom wall 4*a* of the enclosure 4; and in other respects, the seventh embodiment is identical in configuration with the first embodiment.

FIG. 16 shows a coupling portion between the screw-receiving section 26*a* of the first connector body 16 and the screw-receiving section 38*a* of the second connector body 17. As shown in FIG. 16, the bottom wall 4*a* of the enclosure 4 has a boss 100 projecting toward the second printed wiring board 12. A flat support face 101 for supporting the second printed wiring board 12 is formed on the top end of the boss 100. The support face 101 is located immediately below the screw-receiving section 38*a* of the second connector body 17.

Furthermore, the boss 100 has a screw hole 102 open into the support face 101. The screw hole 102 opposes the insertion hole 40 in the second printed wiring board 12.

The fixing screw 42 continually passes through the insertion hole 28 in the first printed wiring board 11, the through hole 27 in the screw-receiving section 26*a*, the through hole 39 in the screw-receiving section 38*a*, and the insertion hole 40 in the second printed wiring board 12; and is screwed into the screw hole 102 in the boss 100. As a result of this screwing-in, the first and second printed wiring boards 11 and 12, and the first and second connector bodies 16 and 17 are pinched between the head 42*a* of the fixing screw 42 and the support face 101 of the boss 100. Accordingly, the boss 100 also functions as a fastening member.

Therefore, the present embodiment is also configured such that, when the fixing screw 42 is screwed in, such a load as to restrain relative movement is applied on the first and second printed wiring boards 11 and 12, and the first and second connector bodies 16 and 17.

Meanwhile, an electronic apparatus according to the invention is not limited to a portable computer. For instance, the invention can also be embodied as another electronic apparatus, such as a cellular phone or a FDA (personal digital assistant), in a similar manner.

What is claimed is:

1. A connector comprising:

a first connector body having a plurality of first lead terminals soldered onto a first wiring board;

a second connector body having a plurality of second lead terminals soldered onto a second wiring board, the second connector body being positioned on a upper face of the second wiring board;

a screw member; and a fastening member engageable to the screw member, the fastening member being soldered to a lower face of the second wiring board and the lower face being opposite to the upper face of the second wiring board;

wherein the first connector body and the second connector body are engaged with each other to bring the first lead terminals and the second lead terminals into contact such that the first lead terminals and the second terminals electrically connect the first wiring board to the second wiring board; and the first and second wiring boards and the first and second connector bodies are integrally fastened together by engaging the screw member to the fastening member.

2. The connector according to claim 1, wherein the screw member continually penetrates through the first and second wiring boards and at least one of the first and second connector bodies when the first connector body and the second connector body are engaged with each other;

the screw member has a penetrating end that is engageable with the fastening member.

3. The connector according to claim 1, wherein the fastening member includes a screw hole into which the screw member is screwed.

4. The connector according to claim 1, wherein the first connector body has a guide pipe which projects toward the second connector body;

the guide pipe penetrates through the second connector body; and the screw member is screwed into the fastening member while penetrating through the guide pipe.

5. The connector according to claim 1, wherein the fastening member has a pipe-shaped guide section which continually penetrates through at least one of the first wiring board and the second wiring board and the first and second connector bodies; and the screw member is screwed into the fastening member while penetrating through the guide section.

6. The connector according to claim 1, wherein the plurality of first lead terminals includes a first section soldered onto the first wiring board, and a second section exposed to a position where the first connector body and the second connector body are engaged with each other;

the plurality of second lead terminals includes the first section soldered onto the second wiring board, and a second section exposed to a position where the first connector body and the second connector body are engaged with each other; and when the first connector body and the second connector body are engaged with each other, the second section of the first lead terminals and the second section of the second lead terminals are brought into contact with each other.

7. The connector according to claim 1, wherein the first connector body includes a first terminal support section that supports the plurality of first lead terminals, and a first screw-receiving section through which the screw member pass;

the second connector body includes a second terminal support section that supports the plurality of second lead terminals, and a second screw-receiving section through which the screw members pass; and the first screw-receiving section and the second screw-receiving section face with each other at a position apart from the first terminal support section and the second terminal support section.

8. The connector according to claim 7, wherein the fastening member is affixed to one of the first wiring board and the second wiring board prior to insertion of the screw members into the first screw-receiving section and the second screw-receiving section.

9. The connector according to claim 1, wherein at least one of the first connector body and the second connector body includes a spacer section that defines an interval between the first wiring board and the second wiring board; and the screw member continuously penetrates the first wiring board, the second wiring board, and the spacer section.

10. The connector according to claim 9, wherein the fastening member includes a screw hole into which the screw member is screwed; and the fastening member is supported by at least one of the first wiring board and the second wiring board.

11. A connector comprising:

a first connector body having a plurality of first lead terminals soldered onto a first wiring board, the first connector body being positioned on a first surface of the first wiring board;

a second connector body having a plurality of second lead terminals soldered onto a second wiring board, the second connector body being positioned on a first surface of the second wiring board;

a first screw member;

a second screw member; and a fastening member engageable to at least one of the first screw member and the second screw member, the fastening member being held on a second surface of at least one of the first wiring board and the second wiring board by soldering, the second surface being opposite from the first surface of the at least one of the first wiring board and the second wiring board;

wherein the first connector body and the second connector body are engaged with each other to bring the first lead terminals and the second lead terminals into contact such that the first lead terminals and the second terminals electrically connect the first wiring board to the second wiring board; and the first and second wiring boards and the first and second connector bodies are integrally fastened together by the first screw member and the second screw member.

12. The connector according to claim 11, wherein the first connector body includes a first terminal support section that supports the plurality of first lead terminals, and a first screw-receiving section through which the first screw member penetrates;

the second connector body includes a second terminal support section that supports the plurality of second lead terminals, and a second screw-receiving section into which the first and second screw members are screwed; and the first screw-receiving section and the second screw-receiving section face each other at a position apart from the first terminal support section and the second terminal support section.

13. The connector according to claim 11, wherein the plurality of first lead terminals includes a first section soldered onto the first wiring board, and a second section exposed to a position where the first connector body and the second connector body are engaged with each other;

the plurality of second lead terminals includes a first section soldered onto the second wiring board, and a second section exposed to a position where the first connector body and the second connector body are engaged with each other; and when the first connector body and the second connector body are engaged with each other, the second section of the first lead terminals and the second section of the second lead terminals are brought into contact with each other.

14. An electronic apparatus comprising:

an enclosure;

a first wiring board contained in the enclosure the first wiring board having a first surface and a second surface situated opposite to the first surface;

a second wiring board contained in the enclosure so as to oppose the first wiring board, the second wiring board including a first surface and a second surface situated on an opposite side of the second wiring board from the first surface; and a connector unit interposed between the first wiring board and the second wiring board and separately formed from the enclosure, the connector unit includes:

a first connector body having a plurality of first lead terminals soldered onto a first wiring board and situated on the first surface of the first wiring board, a second connector body having a plurality of second lead terminals soldered onto a second wiring board and situated on the first surface of the second wiring board, a screw member, and a fastening member engageable to the screw member, the fastening member being held on a second surface of at least one of the first wiring board and the second wiring board by soldering;

the first connector body and the second connector body are engaged with each other to bring the first lead terminals and the second lead terminals into contact such that the first lead terminals and the second terminals electrically connect the first wiring board to the second wiring board; and the first and second wiring boards and the first and second connector bodies are integrally fastened together by engaging the screw member to the fastening member.

15. The electronic apparatus to claim 14, wherein the screw member continually penetrates through the first and second wiring boards and at least one of the first and second connector bodies when the first connector body and the second connector body are engaged with each other;

to screw member has a penetrating end that is engageable with the fastening member.

16. The electronic apparatus according to claim 14, wherein the fastening member includes a boss which projects from to enclosure and which has a screw hole into which the screw member is screwed.

* * * * *